US005779075A

United States Patent [19]

Salmon et al.

[11] Patent Number: 5,779,075

[45] Date of Patent: Jul. 14, 1998

[54] SCREW CAP AND A TAMPER-PROOFING RING, PACKAGING PROVIDED WITH SUCH A CAP, A METHOD OF MANUFACTURING SUCH A CAP, AND A METHOD OF MANUFACTURING SUCH PACKAGING

[75] Inventors: Pierre Salmon, Chatillon-D'Azergues; Jean-Patrice Racine, Saint Andre-De-Crocy, both of France

[73] Assignee: Novembal, Paris, France

[21] Appl. No.: 605,018

[22] PCT Filed: Jul. 29, 1994

[86] PCT No.: PCT/FR94/00965

§ 371 Date: Mar. 27, 1996

§ 102(e) Date: Mar. 27, 1996

[87] PCT Pub. No.: WO95/06598

PCT Pub. Date: Mar. 9, 1995

[30] Foreign Application Priority Data

Sep. 3, 1993 [FR] France ..... 93/10542
Nov. 5, 1993 [FR] France ..... 93/13180

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,206,851 | 6/1980 | Ostrowsky | 215/246 |
| 4,352,436 | 10/1982 | Chartier et al. | 215/252 |
| 4,458,821 | 7/1984 | Ostrowsky | 215/252 |
| 4,530,436 | 7/1985 | Weidmer | 215/246 |
| 4,588,100 | 5/1986 | Itsubo et al. | 215/252 |
| 4,744,479 | 5/1988 | Schottli | 215/252 |
| 5,056,675 | 10/1991 | Julian | 215/252 |
| 5,080,246 | 1/1992 | Hayes | 215/252 |
| 5,129,530 | 7/1992 | Fuchs | 215/252 |
| 5,176,270 | 1/1993 | Battagazzore | 215/252 |
| 5,207,783 | 5/1993 | Burton | 215/256 |
| 5,397,009 | 3/1995 | Salmon et al. | 215/252 |

*Primary Examiner*—Stephen Cronin
*Attorney, Agent, or Firm*—Young & Thompson

[57] ABSTRACT

The invention relates to a screw cap made of a plastics material, the cap comprising a closing portion (3); optional sealing means (7) mounted in or integral with the closing portion (3); and a tamper-proofing ring (8) made in one piece with the closing portion (3). According to the invention, the cap comprises a breakable zone (17) of the outer portion (9) enabling it to be opened on unscrewing the cap (1) leads firstly to an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and secondly to a breakable zone (20*a*), to a cut (20*b*), or to a gap (20*c*) in the inner portion (10) so that, on unscrewing the cap (1), the tamper-proofing ring (8) remains associated with the closing portion (3).

34 Claims, 9 Drawing Sheets

SCREW CAP AND A TAMPER-PROOFING RING, PACKAGING PROVIDED WITH SUCH A CAP, A METHOD OF MANUFACTURING SUCH A CAP, AND A METHOD OF MANUFACTURING SUCH PACKAGING

BACKGROUND OF THE INVENTION

1. Field of the Invention

The invention relates to a screw cap made of a plastics material and including a tamper-proofing ring having an inner portion projecting back inside the ring; packaging comprising the combination of such a cap, and of a container; a method of manufacturing such a cap; and a method of manufacturing such packaging.

2. Description of the Related Art

Screw caps made of plastics materials are known. Such a cap comprises:

a closing portion having a transverse end wall and a skirt adjoining the wall, and provided with an inside thread;

optional sealing means mounted in or integral with the closing portion; and a tamper-proofing ring made in one piece with the closing portion, and having an outer portion forming a closed loop, disposed in alignment with the skirt, and connected thereto via link means spaced apart circumferentially between the free edge of the outer portion and the free edge of the skirt, the other edge of the outer portion directly adjoining a thin edge of an inner portion that can be pivoted about its thin edge relative to the outer portion, the inner portion being designed to project back inside the ring towards the transverse end wall such that it interferes with a projection on a container on which the cap is to be screwed.

In the state of the art disclosed in Documents U.S. Pat. No. 4,613,052, U.S. Pat. No. 4,352,436, and U.S. Pat. No. 4,653,657, the link means linking the outer portion, and therefore the tamper-proofing ring, to the skirt are constituted by breakable bridges that are broken on unscrewing the cap.

On unscrewing the cap, the breakable bridges are broken and the ring is separated from the closing portion while remaining threaded over the neck of the container from which it is difficult to remove the ring since the inner portion of the ring abuts against the projection on the container.

SUMMARY OF THE INVENTION

An object of the invention is to provide a screw cap of the above-mentioned type in which the tamper-proofing ring can be removed from the neck of the container.

To this end, in a first aspect, the invention provides a screw cap made of a plastics material, and of the above-described type, in which a breakable zone of the outer portion of said tamper-proofing ring enabling it to be opened on unscrewing the cap leads firstly to an empty space between the outer portion and the skirt, which empty space is delimited downstream, with respect to the unscrewing direction of the cap, by at least one non-breakable fastening which does not break on unscrewing the cap, and which is part of said link means, and secondly to a breakable zone, to a cut, or to a gap in the inner portion so that, on unscrewing the cap, the tamper-proofing ring remains associated with the closing portion via the non-breakable fastening(s).

The cap has other characteristics, some of which are optional: a breakable zone comprises a thin region in the corresponding portion, i.e. the outer portion or the inner portion. Such a thin region is constituted by a recess in the outer portion or in the inner portion, such as a groove in the outside face of the portion and/or a groove in its inside face. A breakable zone of the outer portion extends in a generally inclined direction relative to the axis of the cap in the opposite direction to the thread. A breakable zone or a cut in the inner portion extends in a generally inclined direction relative to the axis of the cap in the same direction as or in the opposite direction to the thread. The general direction of the inclination of the breakable zone or of the cut forms an angle lying in the range 30° to 80° with the axis of the cap, and preferably an angle equal to or in the vicinity of 45°. A breakable zone or a cut in the inner portion or in the outer portion extends substantially along a rectilinear direction. A breakable zone in the outer portion leads to the empty space between the outer portion and the skirt substantially orthogonally to the axis of the cap so that it substantially extends the empty space. A breakable zone has at least one segment that is orthogonal to the axis of the cap and that is interposed between two segments that are inclined relative to the axis. A non-breakable fastening is immediately adjacent to the end of a breakable zone in the outer portion leading to the free edge thereof. A non-breakable fastening is strong enough not to break on unscrewing the cap, but it is not strong enough to withstand a large enough traction force applied by the user after the cap has been unscrewed so as to break the fastening. A gap in the inner portion is constituted by an empty space that extends circumferentially in said inner portion. The empty space of such a gap in the inner portion extends over an arc lying in the range 20° to 100°, and preferably approximately in the range 30° to 90°. The empty space of such a gap in the inner portion extends over an arc of angle substantially corresponding to the angle through which a facing non-breakable fastening extends. The two edges delimiting a gap in the inner portion are disposed either substantially in axial planes of the cap, or such that they diverge from the thin edge of the inner portion to its free edge. The edges delimiting a gap in the inner portion are inclined relative to the axis of the cap at an angle equal to or in the vicinity of 45°. The outer portion has a thickness that remains substantially constant over its entire periphery and over its entire axial height except in the breakable zone(s) with which it is provided, the thickness being not more than substantially equal to, or optionally less than, the thickness of the skirt. The inner portion extends over an axial height which is not more than the axial height of the outer portion which entirely covers the inner portion. In particular, the inner portion extends over about one half of the axial height of the outer portion. Or conversely, the inner portion extends over an axial height that is greater than the axial height of the outer portion which covers the inner portion in part only, with the inner portion partially overlapping the skirt. The the right axial section of the inner portion is generally triangular or trapezium-shaped. The link means are constituted by the non-breakable fastenings only, or conversely, they are constituted both by the non-breakable fastenings and also by breakable bridges that are spaced apart circumferentially, and that are broken on unscrewing the cap. In the first case, at least two breakable zones are provided in the outer portion and in the inner portion. The right cross-section of a breakable bridge is generally triangular with a base adjoining the inside face of the skirt, and the inside face of the outer portion, and an opposite vertex facing outwards. Said vertex is disposed slightly set back from the outside face of the skirt and from the outside face of the outer portion. In axial elevation, a breakable bridge is generally triangular or trapezium-shaped with a large side adjoining the outer portion, and a vertex or a small side adjoining the skirt. A breakable bridge extends in a generally axial direction. Conversely, a breakable bridge extends in a generally inclined direction relative to the axis of the cap. This direction is the direction of the thread of the cap. The cap includes four, five, or six breakable bridges. A non-breakable fastening is spaced apart from the first breakable bridge situated upstream relative to the unscrewing direction of the cap by an arc of angle lying approximately in the range 45° to 90°. A non-breakable fastening also serves to constrain the ring to rotate with the closing portion. The cap includes at least one axial abutment in the form of a projection on the skirt and/or a projection on the outer portion, such a projection being situated in the empty space provided between the skirt and the outer portion, a projection on the skirt extending the skirt from its free edge towards the outer portion, and a projection on the outer portion extending the outer portion from its free edge towards the skirt. An abutment extends circumferentially over an arc of less than about 40°. Two adjacent abutments are separated from each other by at least one breakable bridge or by a non-breakable fastening. Two adjacent abutments are separated from each other by not more than four breakable bridges. A non-breakable fastening is separated from the first breakable bridge situated upstream relative to the unscrewing direction of the cap by an abutment. An abutment adjoining the skirt has rounded edges and has a radial thickness that is substantially equal to the radial thickness of the skirt. The abutments occupy approximately in the range one third to one half of the circumference of the empty space between the skirt and the outer portion. A non-breakable fastening is situated substantially diametrically opposite from another non-breakable fastening or from a breakable bridge. The inner portion is inclined relative to the outer portion at an angle lying approximately in the range 10° to 60°, more specifically approximately in the range 20° to 40°, and in particular equal to or in the vicinity of 30°. The inner portion has its free edge radially spaced apart from the outer portion or from the skirt.

In a first variant embodiment, the cap includes a single non-breakable fastening, and a single breakable zone, cut, or gap in the inner portion. In this variant, four breakable bridges are substantially uniformly distributed over one half of the periphery of the cap opposite from the breakable zone of the outer portion, and from the breakable zone, cut, or gap in the segments of the inner portion that are separated by said breakable zones, cuts, or gaps. Three abutments are also provided, two of which are diametrically opposite each other, the third abutment being diametrically opposite the non-breakable fastening.

In a second variant embodiment, the cap includes two substantially diametrically opposite non-breakable fastenings, and two substantially diametrically opposite breakable zones, cuts, or gaps in the inner portion. In this variant six breakable bridges are provided that are substantially diametrically opposite one another, and that are situated in the middles of the inner portion. Four abutments are also provided opposite one another in pairs, and separated from one another either by the breakable bridges or by the non-breakable fastenings.

In a third variant embodiment, the cap includes three non-breakable fastenings disposed at substantially 120° from one another, and three breakable zones, cuts, or gaps in the inner portion also disposed at substantially 120° from one another. In this variant, six breakable bridges are disposed at substantially 120° from one another, situated substantially in the middles of the inner portion, and diametrically opposite the non-breakable fastenings. Six abutments are also disposed at substantially 120° from one another.

In a fourth variant embodiment, the cap includes four non-breakable bridges spaced apart from one another by substantially one fourth of a turn. In this variant, four breakable bridges and four breakable zones, cuts or gaps in the inner portion are provided that are spaced apart from one another by substantially one fourth of a turn, non-breakable fastenings being provided as the only link means, and four breakable zones in the inner portion being provided spaced apart from one another by substantially one fourth of a turn.

In a fifth variant embodiment, the free edge of the inner portion lies in a single plane inclined relative to a reference plane which is orthogonal to the axis of the cap and in the same direction as the thread of the cap.

In a sixth variant embodiment, the free edge of the inner portion lies in a single plane inclined relative to a reference plane which is orthogonal to the axis of the cap and in the opposite direction to the thread of the cap.

In a seventh variant embodiment, the free edge of the inner portion is situated in several planes inclined relative to a reference plane which is orthogonal to the axis of the cap. In this case the internal portion may form some number of indentations that are of greater or lesser size.

In a second aspect, the invention provides packaging comprising the combination of such a cap and of a container having a neck which is provided firstly with an outside thread in the vicinity of its opening, which thread co-operates with the inside thread of the cap, and secondly with an annular projection in the vicinity of the base of the neck, the projecting inner portion of the cap abutting against the annular projection at the opposite end of the neck from the outside thread.

In such packaging, the inner portion is inclined relative to the outside portion at an angle such that unscrewing the cap causes the inner portion to pivot about its thin edge in the direction tending to move it away from the outer portion.

In a third aspect, the invention provides a method of manufacturing such a cap, the method being characterized by the fact that, firstly the cap is made by injection with the inner portion extending the outer portion, and the inner portion is then pivoted about its thin edge so that it projects back inside the ring.

In a final aspect, the invention provides a method of manufacturing packaging as mentioned above, in which method the cap is screwed onto the container once the inner portion has been pivoted so that it projects back inside the ring.

BRIEF DESCRIPTION OF THE DRAWINGS

The invention will be better understood on reading the following description of several embodiments and of several variants given with reference to the accompanying drawings, in which.

DESCRIPTION OF THE PREFERRED EMBODIMENT

Figure 2:
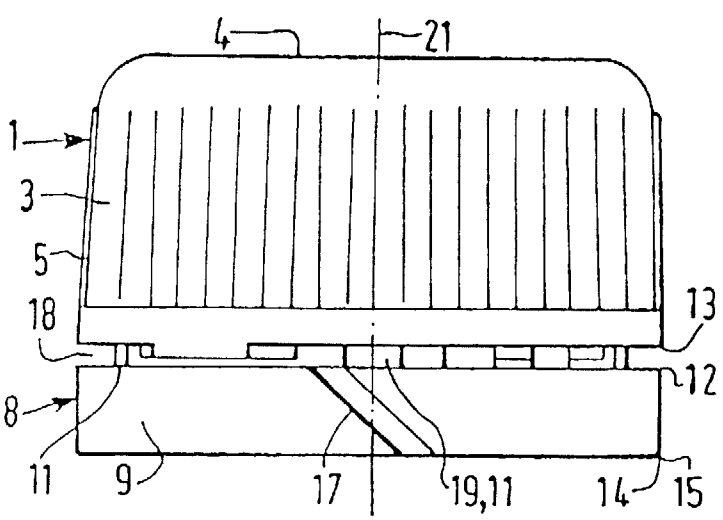
FIG. 2 is a diagrammatic cross-section view on line II—II of FIG. 1.

The invention relates to a cap 1 for a container 2, the resulting assembly forming packaging.

The cap 1 is of the screw type and is made of a plastics material.

It includes a closing portion 3 having a transverse end wall 4, and a skirt 5 adjoining the wall 4 and provided with an inside thread 6.

Figure 4:
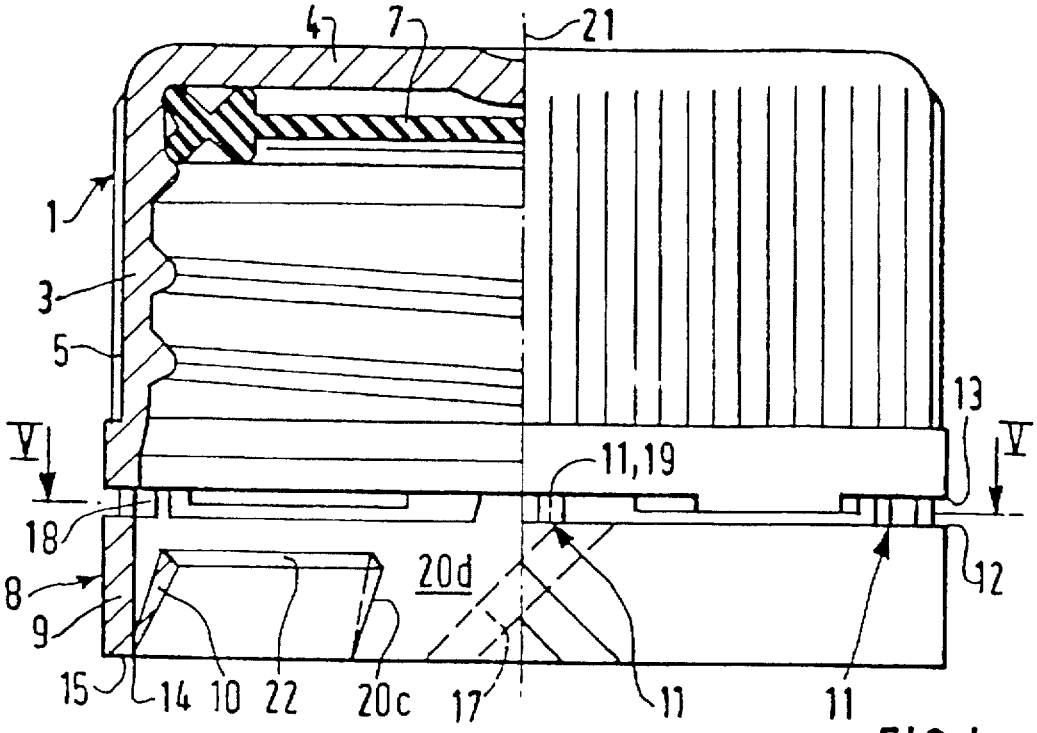
FIG. 4 is a diagrammatic view partly in axial section (left half-view), and partly in elevation (right half-view) of a second variant of the cap of the invention.

The cap 1 may further include optional sealing means 7 which are either integral with the closing portion (see FIG. 1), or else they are separate and mounted therein (see FIG. 4).

The cap 1 also includes a tamper-proofing ring 8 which is made in one piece with the closing portion 3.

The ring 8 comprises an outer portion 9 and an inner portion 10.

The outer portion 9 forms a closed loop and is disposed in alignment with the skirt 5.

The outer portion 9 is connected to the skirt 5 by link means 11 that are spaced apart from one another circumferentially, and that are situated between the free edge 12 of the outer portion 9 and the free edge 13 of the skirt 5.

The inner portion 10 directly adjoins the outer portion 9. For that purpose, the inner portion 10 has a thin edge 14 adjoining the other edge 15 of the outer portion 9. In this way, the outer portion 9 is delimited by its free edge 12 on the skirt side, and by its other edge 15 on the opposite side.

The inner portion 10 is capable of pivoting about its thin edge 14 relative to the outer portion 9.

The inner portion 10 is designed to project back inside the ring 8 towards the transverse wall 4.

Figure 18:
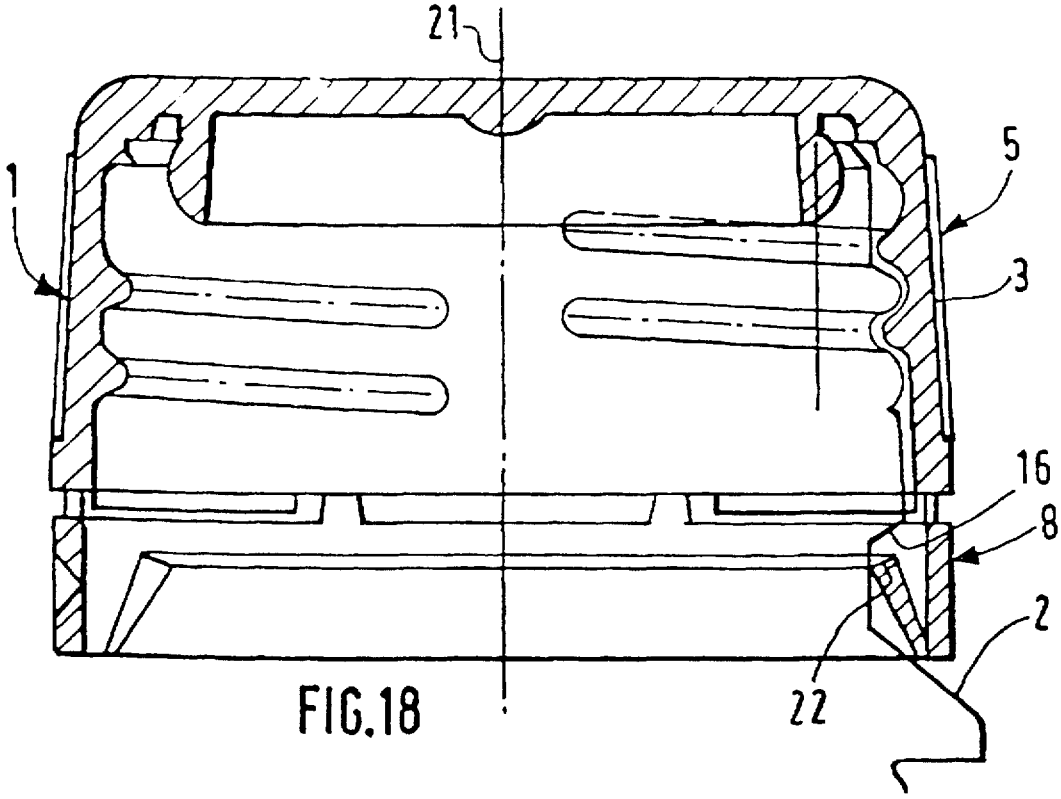
FIG. 18 is a diagrammatic axial section view of the cap of the invention mounted on a container.

When the cap 1 is screwed onto the container 2, the inner portion 10 interferes with a projection 16 on the container 2 (see FIG. 18).

The outer portion 9 includes one or more breakable zones 17 which enable the outer portion to be opened on unscrewing the cap 1.

Firstly, such a breakable zone 17 leads to an empty space 18 between the outer portion 9 and the skirt 5. The empty space 18 is delimited downstream by at least one non-breakable fastening 19 that does not break on unscrewing the cap. Such a non-breakable fastening 19 is part of the link means 11. Secondly, a breakable zone 17 of the outer portion 9 leads either to a breakable zone 20*a* of the inner portion 10, or to a cut 20*b* therein, or to a gap 20*c* therein.

In this way, on unscrewing the cap 1, the tamper-proofing ring 8 remains associated with the closing portion 3.

The terms upstream and downstream as used herein refer to the cap unscrewing direction.

The terms axial and transverse refer to the axis 21 of the cap.

Figure 10A:
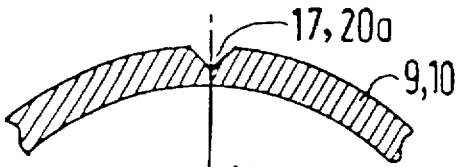
FIGS. 10A, 10B, and 10C are three fragmentary diagrammatic views showing embodiments of a breakable zone in the outer portion or in the inner portion.
Figure 10B:
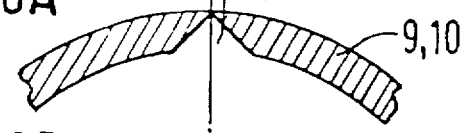
Figure 10C:
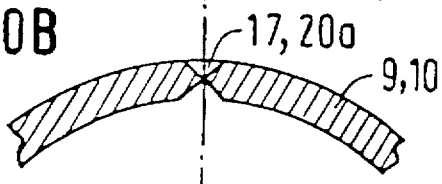

The expression "breakable zone" is used to designate a zone in which the plastics material can be broken by a large enough force being applied to it. Such a breakable zone may include a thin region of the plastics material. Such a thin region may be constituted by a recess such as a groove. Such a groove may be provided in the outside face (FIG. 10A), in the inside face (FIG. 10B), or both in the outside face and in the inside face (FIG. 10C) of the outer portion 9 or of the inner portion 10.

The term "cut" is used to designate a zone in which the continuity of the plastics material is broken without a significant empty space. A typical case of such a break is a slit without any material being removed.

The term "gap" is used to designate a zone in which there is a break in the continuity of the plastics material with an empty space 20*d*.

Figure 11A:
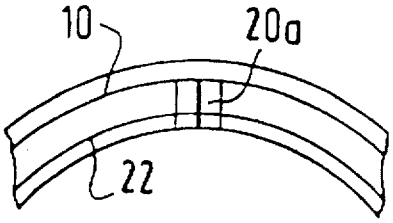
FIGS. 11A, 11B, and 11C are three fragmentary diagrammatic views of the inner portion of the ring showing implementations of a breakable zone, of a cut, and of a gap.
Figure 11B:
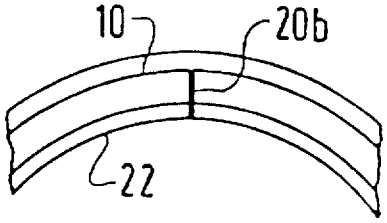
Figure 11G:
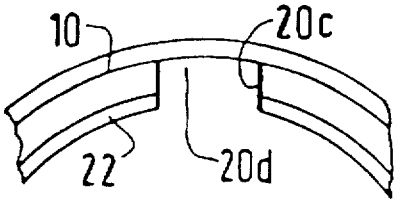

FIGS. 11A, 11B, and 11C show the three corresponding embodiments for the inner portion 10. A breakable zone 20*a* is shown in FIG. 11A. A cut 20*b* is shown in FIG. 11B. A gap 20*c* with its empty space 20*d* is shown in FIG. 11C. In the embodiments considered, a breakable zone 17 of the outer portion 9 extends in a generally inclined direction relative to the axis 21 of the cap. This direction is inclined in the opposite direction to the thread 6, as shown clearly in FIGS. 1 to 3. A breakable zone 20*a* or a cut 20*b* in the inner portion 10 extends in a generally inclined direction relative to the axis 21 of the cap 1.

Figure 17A:
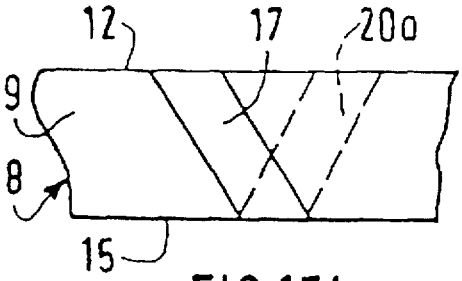
FIGS. 17A and 17B are fragmentary diagrammatic elevation views of the tamper-proofing ring showing the relative disposition of a breakable zone in the outer portion, and of a breakable zone, a cut, or a gap in the inner portion.
Figure 17B:
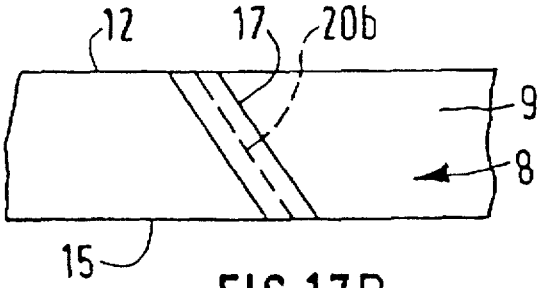

In a first embodiment, this direction is inclined in the same direction as the thread 6 (see FIG. 17A). This embodiment corresponds to the case in which, while the cap is being manufactured, and when the inner portion 10 extends the outer portion 9, the breakable zone 20*a* or the cut 20*b* itself extends the breakable portion 17.

In a second embodiment, the direction of the breakable zone 20*a* or of the cut 20*b* is the same as that of the breakable zone 17, i.e. it is inclined in the opposite direction to the thread 6. This situation occurs when, during cap manufacture, the breakable zone 20*a* or the cut 20*b* extends in a direction substantially symmetrical to the direction of the breakable zone 17 about a transverse plane including the edges 14, 15.

The general direction of the inclination of the breakable zone 17, 20*a*, or of the cut 20*b* forms an angle lying in the range 30° to 80° with the axis 21. Preferably, the angle is equal to or in the vicinity of 45°.

Preferably, the angle of inclination of the breakable zone 17 is the same as the angle of inclination of the breakable zone 20*a* or of the cut 20*b*.

A breakable zone 17 extends from edge 12 to the opposite edge 15. A breakable zone 20*a*, a cut 20*b*, or a gap 20*c* extends from the thin edge 14 to the free edge 22 of the inner portion 10.

A breakable zone 17, 20*a* or a cut 20*b* extends essentially along a rectilinear direction.

Figure 12:
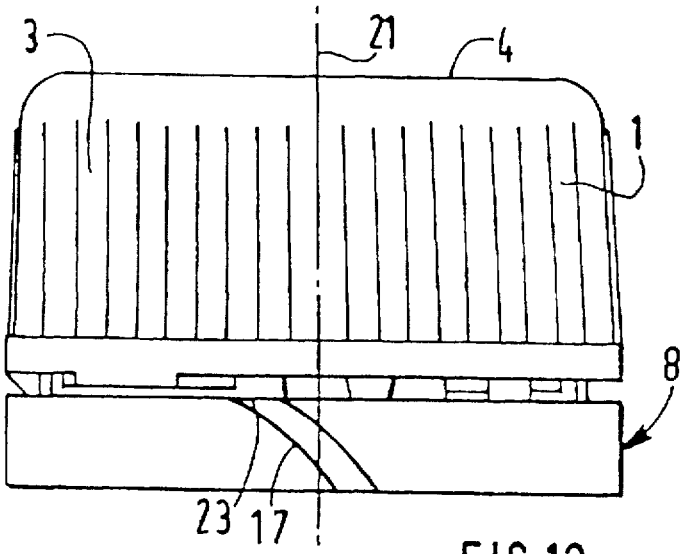
FIG. 12 and FIG. 13 are diagrammatic elevation views showing two embodiments of the breakable zone of the outer portion.

In the embodiment shown in FIG. 12, the breakable zone 17 leads to the empty space 18 substantially orthogonally to the axis 21. Therefore, the breakable zone 17 substantially extends the empty space 18, thereby facilitating breaking the breakable zone 17.

In this embodiment, and when the breakable zone 17 extends essentially along a rectilinear direction that is inclined relative to the axis 21, the breakable zone 17 ends in curved segment 23 in the vicinity of edge 12.

Figure 13:
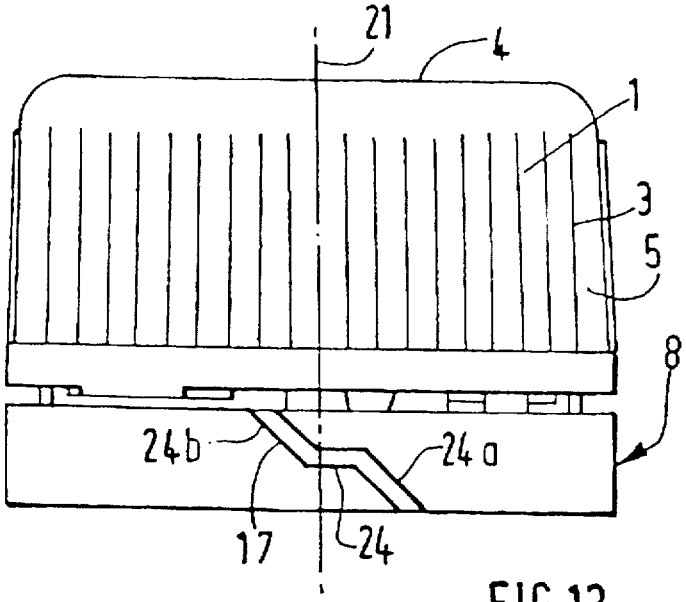

In the embodiment shown in FIG. 13, a breakable zone 17 in the outer portion 9 has a segment 24 that is orthogonal to the axis 21 of the cap. The orthogonal segment 24 is interposed between two inclined segments 24*a*, 24*b* that are inclined relative to the axis 21. This disposition enables forces to be transmitted in the direction of the axis 21.

In another embodiment (not shown), the breakable zone 17 includes a plurality of segments 24.

A non-breakable fastening 19 is immediately adjacent to the end portion of a breakable zone 17 of the outer portion 9, which breakable zone leads to the free edge 12 thereof. On unscrewing the cap 1, the empty space 18 tends to be widened. When a non-breakable fastening 19 which cannot be broken by merely unscrewing the cap 1 is reached, the axial forces are applied immediately to the breakable zone 17 because that zone adjoins the non-breakable fastening 19. The non-breakable fastening 19 contributes to transferring the breaking forces from the cap 1 to the breakable zone 17.

Although a non-breakable fastening 19 is not broken on unscrewing the cap 1, it may be such that it is not strong enough to withstand being broken by a sufficient traction force being exerted by the user after the cap has been unscrewed.

In this embodiment, once it has been removed, the cap includes the tamper-proofing ring 8 adjoining the closing portion. The user can then separate the tamper-proofing ring 8 from the closing portion 3. Not only is the neck of the container then free of the ring 8, but the ring 8 is removed from the closing portion 3.

A gap 20*c* in the inner portion 10 is constituted by the empty space 20*d* and extends circumferentially about the axis 21. The empty space extends over an arc lying in the range 20° to 100°, and preferably in the range 30° to 90°. The arc has an angle corresponding substantially to that of the facing non-breakable fastening 19. In the embodiment shown in FIG. 7, the two edges delimiting a gap 20*c* in the inner portion 10 are disposed in planes that are substantially axial planes of the cap 1. In the variant embodiment shown in FIG. 2, the edges are placed such that they diverge from the thin edge 14 to the free edge 22.

The edges delimiting a gap 20*c* in the inner portion 10 are inclined at an angle equal to or in the vicinity of 45° to the axis 21 of the cap 1.

The outer portion 9 is of substantially constant thickness over its entire periphery, and over its entire axial height except in the breakable zone(s) 17 with which it is provided. Its thickness is not more than substantially equal to, or optionally less than, the thickness of the skirt 5. The skirt is preferably provided with axial fluting so as to improve the grip of the closing portion 3 in the fingers of the user, and so as to prevent the closing portion from slipping relative to said fingers.

Figure 1:
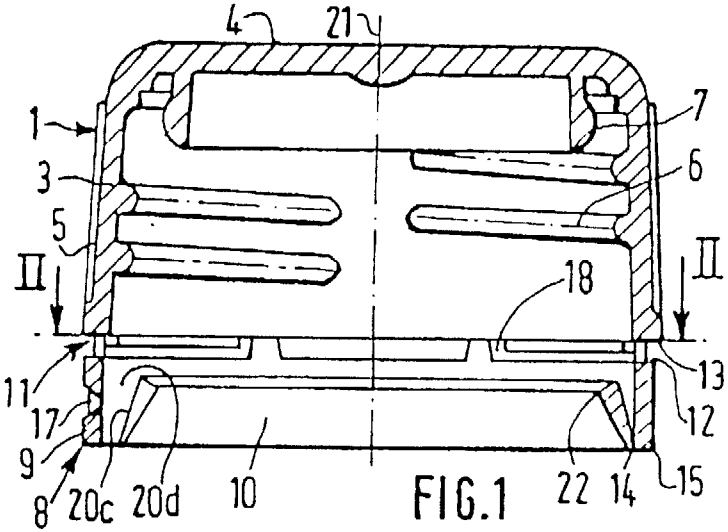
FIG. 1 is a diagrammatic axial section view of a first variant embodiment of the cap.
Figure 6:
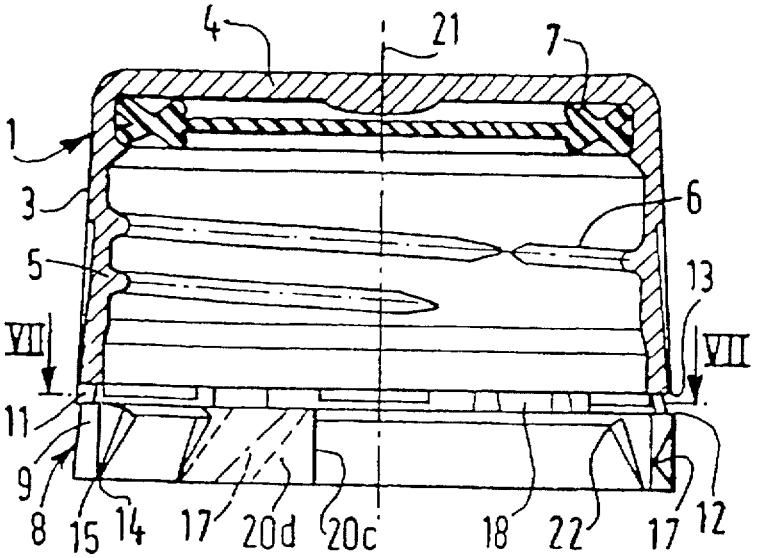
FIG. 6 is a diagrammatic axial section view of a third variant of the cap.

In the embodiment shown in FIGS. 1, 4, and 6, the inner portion 10 extends over an axial height that is not greater than the axial height of the outer portion 9. The outer portion 9 then entirely covers the inner portion 10. In particular, the inner portion 10 extends over about half of the axial height of the outer portion 9 (see FIG. 4).

Figure 14:
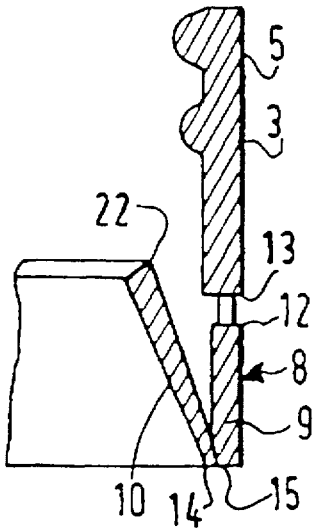
FIG. 14 is a fragmentary diagrammatic axial section view showing an embodiment of the cap in which the axial height of the inner portion of the ring is greater than the axial height of the outer portion of the ring.

In another variant embodiment (FIG. 14), the inner portion 10 extends over an axial height that is greater than the axial height of the outer portion 9. The outer portion 9 then covers the inner portion 10 in part only, the inner portion then partially overlapping the skirt 5 in the vicinity of the free edge 13 thereof.

In the embodiments shown, the right axial section of the inner portion 10 is generally triangular or trapezium-shaped with a vertex defined by the thin edge 14, and an opposite base defined by the thick free edge 22. The thickness of the inner portion 10 then increases uniformly from edge 14 to the opposite free edge 22.

In a first embodiment of the invention, the link means 11 are constituted by the non-breakable fastenings 19 only. At least two breakable zones 17 are then provided in the outer portion 9, and two breakable zones 20*a* are provided in the inner portion 10. In this way, the inner portion 10 is provided with breakable zones 20*a* rather than with cuts 20*b* or with gaps 20*c* so that the inner portion 10 constitutes a closed annular loop contributing to the strength of the outer portion 9.

In another embodiment of the invention, the link means 11 are constituted both by the non-breakable fastenings 19, and also by breakable bridges 26 which are spaced apart from one another circumferentially, and which are broken on unscrewing the cap.

The variants shown in FIGS. 1 to 8 correspond to the link means 11 comprising both non-breakable fastenings 19 and also breakable bridges 26. The variant shown in FIG. 9 corresponds to the link means 11 comprising non-breakable fastenings 19 only, no breakable bridge, such as 26, then being provided.

Figure 5:
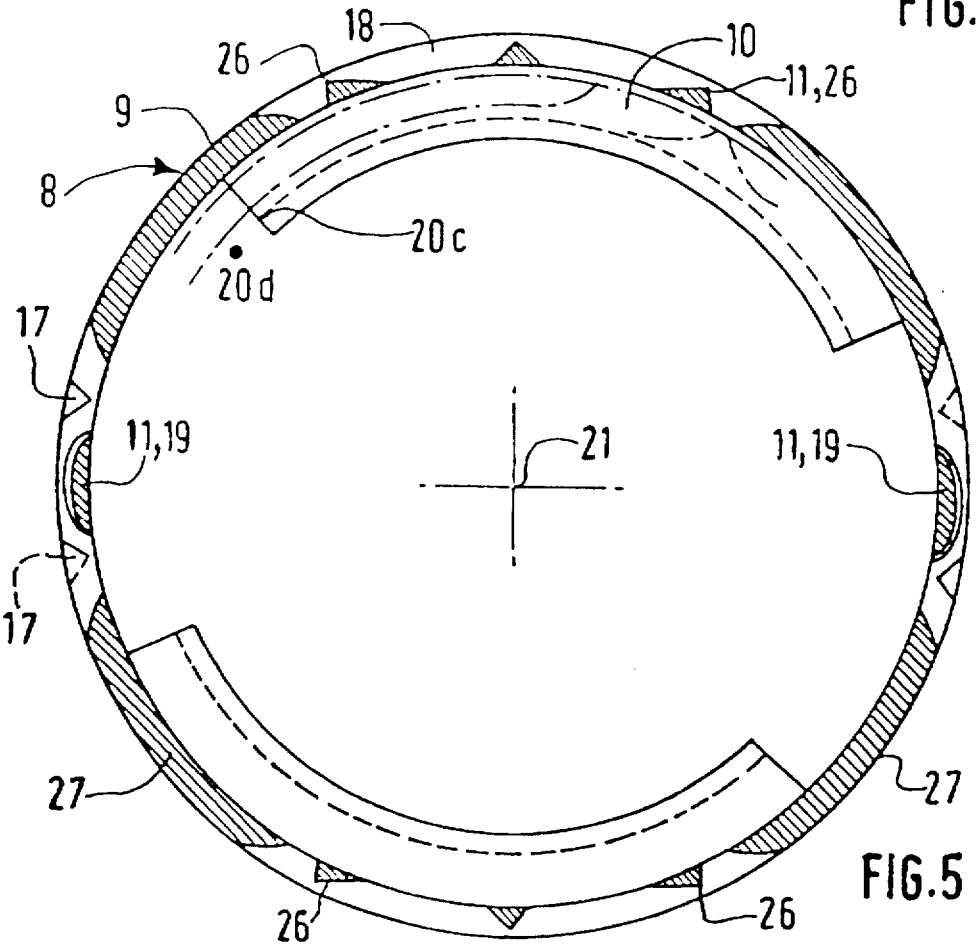
FIG. 5 is a cross-section view on line V—V of FIG. 4.

Reference is made more specifically below to FIGS. 5 and 15.

The right cross-section of a breakable bridge 26 is generally triangular with a base adjoining the inside face of the skirt 5 and the inside face of the outer portion 9, and an opposite vertex facing outwards. The bridge is disposed such that the cap can be removed from the mold. The vertex of the breakable bridge 26 is disposed slightly set back from the outside face of the skirt 5, and from the outside face of the outer portion 9. In axial elevation, a breakable bridge 26 is generally triangular or trapezium-shaped with a large end adjoining the outer portion 9 and a vertex or a small end adjoining the skirt 5.

Figure 15:
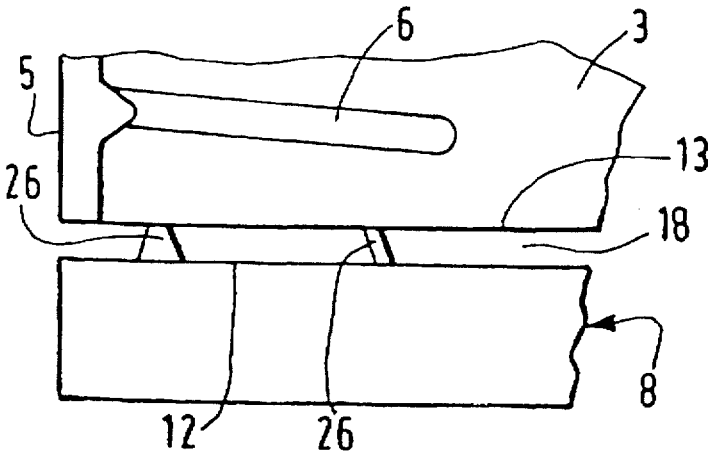
FIG. 15 is a fragmentary diagrammatic elevation view showing two embodiments of breakable bridges.

In a possible embodiment, a breakable bridge 26 extends in a generally inclined direction relative to the axis of the cap (see the breakable bridge shown on the right of FIG. 15). This general direction is inclined in the same direction as the thread 6.

When the cap of the invention is provided with breakable bridges 26, it has as small a number of bridges as possible. The minimum number is about four, five or six.

A non-breakable fastening 19 is distant from the breakable bridge 26 situated towards the upstream end of an arc lying in the range 45° to 90°.

A non-breakable fastening 19 may also be used to constrain the ring 8 to rotate with the closing portion 3.

Figure 16:
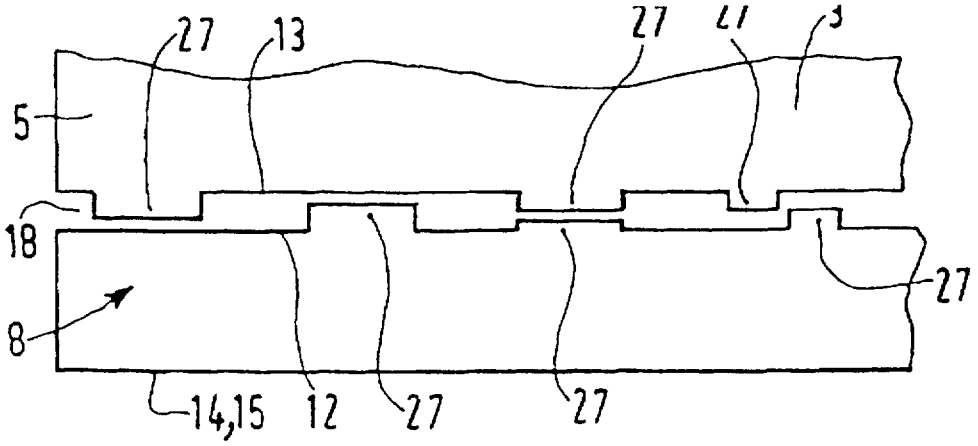
FIG. 16 is a fragmentary diagrammatic elevation view showing four embodiments of abutments for the cap of the invention.

In accordance with another characteristic, the cap is also provided with at least one axial abutment in the form of a projection on the skirt 5 and/or on the outer portion 10, such a projection extending the skirt from its free edge 13 towards the outer portion and/or extending the outer portion from its free edge 12 towards the skirt. Such a projection is situated in the empty space 18. It prevents the empty space 18 from being closed when the cap 1 is installed on the container 2. Such an abutment 27 extends circumferentially over an arc having an angle that is less than about 40°. Two adjacent abutments are separated from each other by at least one breakable bridge 26 or by a non-breakable fastening 19. Two adjacent abutments 27 are separated from each other by at least four breakable bridges 26. A non-breakable fastening 19 is separated from the first breakable bridge 26 by an abutment 27. The radial thickness of an abutment 27 adjoining the skirt 5 is substantially equal to the radial thickness of the skirt 5 and the abutment has two rounded axial edges (see FIG. 5). Abutments 27 occupy approximately in the range one third to one half of the circumference of the empty space 18. Various types of abutment are shown in FIG. 16. The first abutment from the left extends the skirt 5. The second abutment extends the outer portion 9. The third abutment is formed by an extension to the skirt 5 and by an extension to the outer portion 9. The fourth and last abutment is of the same type as the preceding abutment, with each of the two portions overlapping the other so as to constrain the outer portion to rotate with the skirt. A non-breakable fastening 19 is situated substantially diametrically opposite to another non-breakable fastening 19 or to a breakable bridge 26.

Reference is made below to FIGS. 1, 4, 6, and 18 showing an inner portion 10 that is inclined relative to the outer portion 9 at an angle of approximately in the range 10° to 60°, more specifically approximately in the range 20° to 40°, and in particular equal to or in the vicinity of 30°. The angle is such that unscrewing the cap 1 causes the inner portion 10 to pivot about its thin edge 14 away from the outer portion. The inner portion 10 has a free edge 22 that is radially spaced apart from the outer portion 9 or from the skirt 5.

When the cap 1 is installed on the container, the inner portion 10 is disposed on the cap 1 substantially as it was prior to installation, once the inner portion 10 has been pivoted so that it projects back inside the ring 8. The clearance between the inner portion 10 and the outer portion 9 or the skirt 5 makes it possible to take up any dimensional differences relating to the tolerances, in particular on the container 2. Taking up such play is facilitated by the inner portion abutting against the projection 16 inwardly, i.e. towards the axis 21, and not outwardly towards the outer portion 9.

Figure 3:
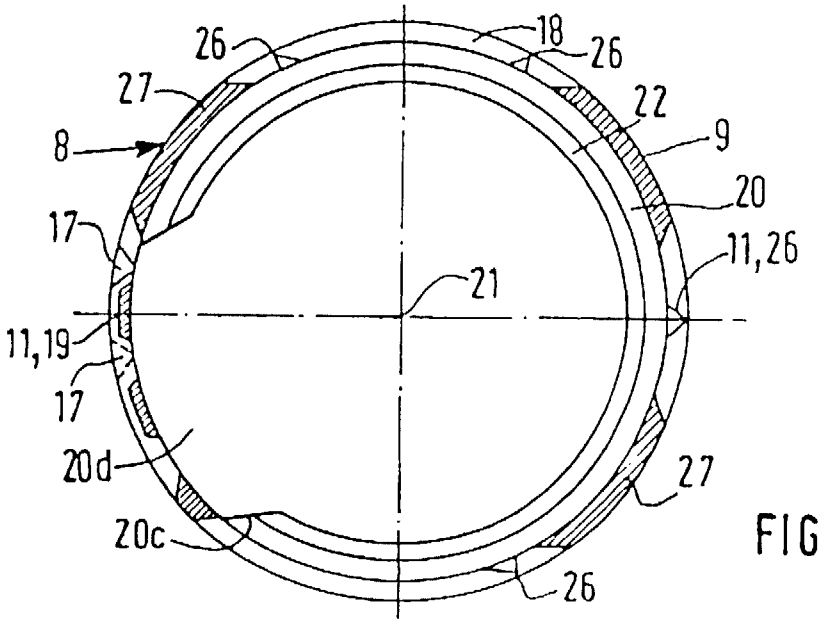
FIG. 3 is a diagrammatic elevation view of the cap of the first variant.

Reference is made more specifically below to FIGS. 1 to 3 showing a first variant embodiment.

In this variant, the cap 1 is provided with a single non-breakable fastening 19 and a single gap **20*c* in the inner portion 10. In other embodiments of the same variant, the gap 20*c* may be replaced with a breakable zone 20*a* or with a cut 20*b*. In the example shown in the drawings, four breakable bridges 26 are distributed substantially uniformly over one half of the periphery of the cap 1 opposite from the breakable zone 17 of the outer portion 9 and opposite from the gap 20*c* in the inner portion 10. Furthermore, three abutments 27 are provided, two of which are substantially diametrically opposite each other, the third abutment being diametrically opposite from the non-breakable fastening 19. In this way, going upstream from the breakable zone 17, the following are encountered in succession: a first abutment 27, a first breakable bridge 26 followed by a second breakable bridge 26, a second abutment 27, a third bridge 26, a third abutment 27, a third and last abutment 27, a fourth and last bridge 26, and three non-breakable fastenings 19. In this embodiment, the inner portion 10** is in the form of an annular loop which is either open or closed, but which is made in one piece.

Reference is made more specifically below to FIGS. 4 and 5 which show a second variant embodiment.

In the second variant, two non-breakable fastenings 19 are provided substantially diametrically opposite each another, and two gaps **20*c* in the inner portion are provided also substantially diametrically opposite each other. As above, gaps 20*c* may be replaced with breakable zones 20*a* or with cuts 20*b***.

In this variant, there are six breakable bridges 26 that are substantially diametrically opposite one another, and that are situated in the middle of the outer portion 9. In addition, four abutments 27 are provided opposite to one another in pairs, and separated from one another either by breakable bridges 26 or by non-breakable fastenings 19. In this way, going upstream about the axis 21 from a breakable zone 17, the following are encountered in succession: a first abutment 27, a first breakable bridge 26 followed by a second breakable bridge 26 followed by a third breakable bridge 26, a second abutment 27, a non-breakable fastening 19, a breakable zone 17, a third abutment 27, a fourth breakable bridge 26 followed by a fifth breakable bridge 26 followed by a sixth breakable bridge 26, a fourth and last abutment 27, and the second non-breakable fastening 19.

Figure 8:
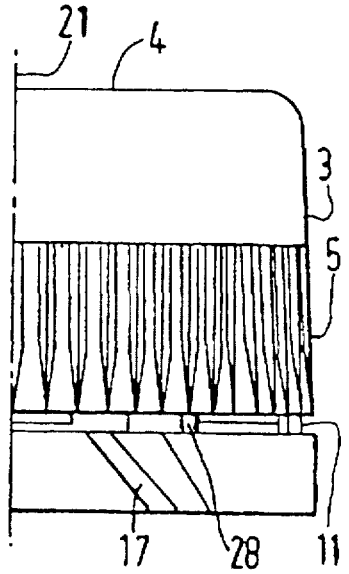
FIG. 8 is an elevation half-view of the cap of the third variant.
Figure 7:
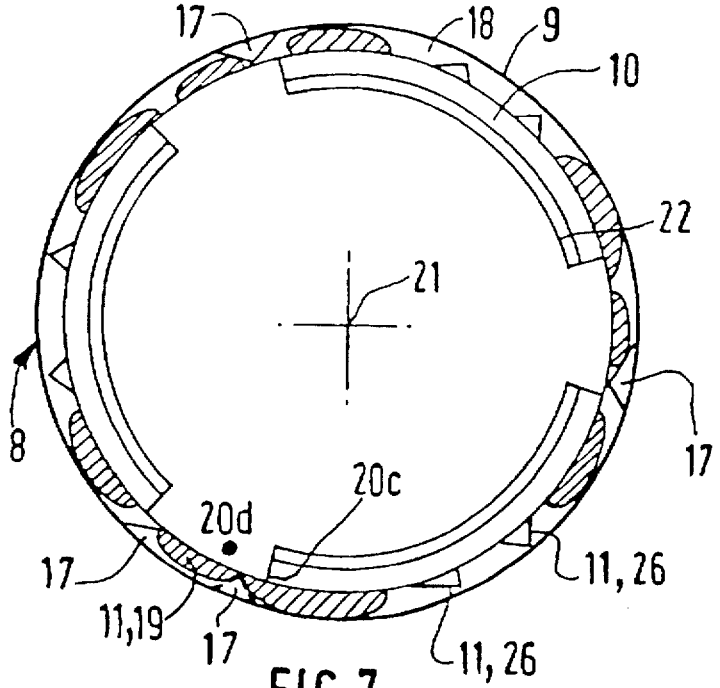
FIG. 7 is a diagrammatic cross-section view on line VII—VII of FIG. 6.

Reference is made more specifically below to FIGS. 6, 7, and 8 showing a third variant embodiment.

In this variant, three non-breakable fastenings 19 are disposed at substantially 120° from one another, and three gaps **20*c* in the inner portion 10 are also disposed at substantially 120° from one another. In this embodiment, there are six breakable bridges 26 which are disposed at substantially 120° from one another, which are situated substantially in the middles of the inner portion segments 10 separated by the gaps, and which are diametrically opposite from the non-breakable fastenings 19. Six abutments 27 are also provided at substantially 120° from one another. Going upstream about the axis 21 from a first breakable zone 17, the following are encountered in succession: a first abutment 27, a first breakable bridge 26 followed by a second breakable bridge 26, a second abutment 27, a non-breakable fastening 19, a second breakable zone 17, a fourth abutment 27, a third breakable bridge 26 followed by a fourth breakable bridge 26, a fourth abutment 27, a non-breakable fastening 19, the third and last breakable zone 17, a fifth breakable bridge 26 followed by a sixth and last breakable bridge 26, a sixth and last abutment 27, and a third non-breakable fastening 19**.

Figure 9:
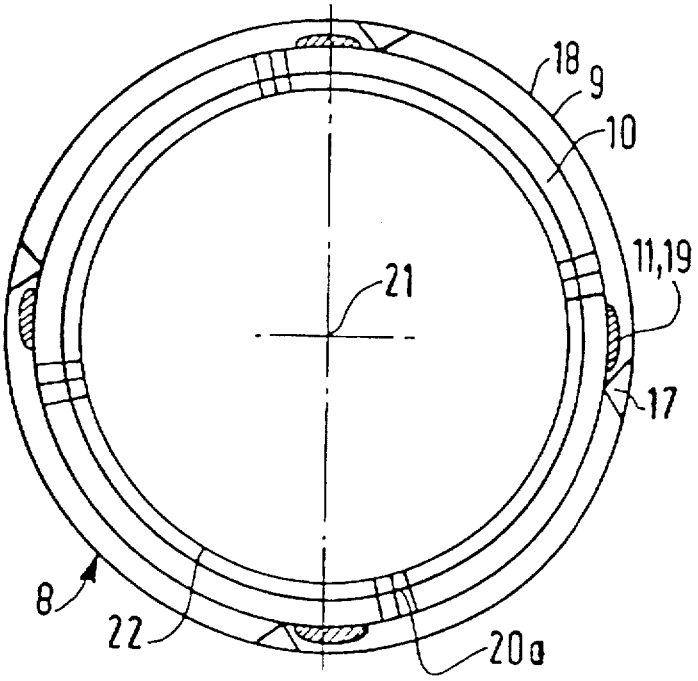
FIG. 9 is a diagrammatic cross-section view of a fourth variant of the cap.

Reference is made more specifically below to FIG. 9 which shows a fourth variant embodiment. In this variant embodiment, four non-breakable fastenings 19 are provided spaced apart from one another by substantially one fourth of a turn. In the variant shown in the drawing, the non-breakable fastenings 19 alone constitute the link means 11, the cap 1 having no breakable bridges 26. The inner portion 10 then includes four breakable zones 20*a* spaced apart from one another by substantially one fourth of a turn.

In an embodiment that is not shown, four breakable bridges 26 and four breakable zones 20*a*, cuts 20*b*, or gaps 20*c* in the inner portion 10 are provided spaced apart from one another by substantially one fourth of a turn.

In a method of manufacturing a cap such as described above, firstly it is made by injection with the inner portion 10 extending the outer portion 9. Then the inner portion 10 is pivoted about its thin edge 14 so as to project back inside the ring 8.

In accordance with the invention, the inner portion 10 is delimited by the free edge 22 lying in one or more planes P that may be inclined relative to a reference plane R which is orthogonal to the axis of the cap.

For example, plane R is the plane defined by the edge 15 of the outer portion 9.

Figure 19:
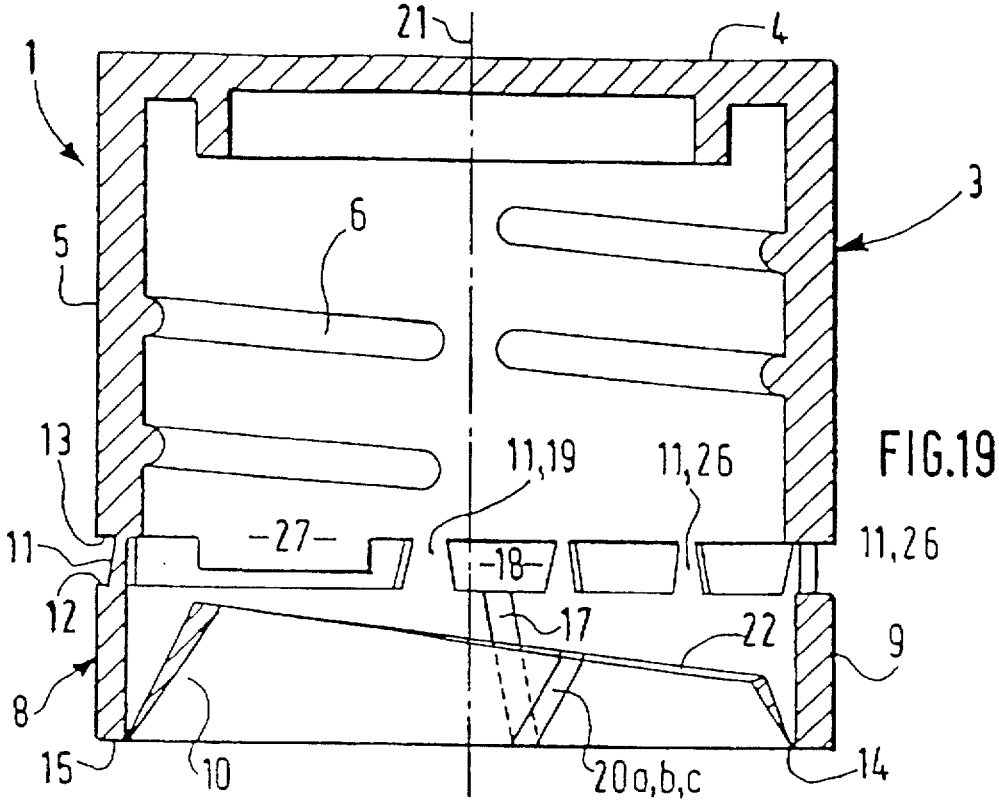
FIG. 19 is a diagrammatic axial section view of a fifth variant embodiment of the cap.
Figure 20:
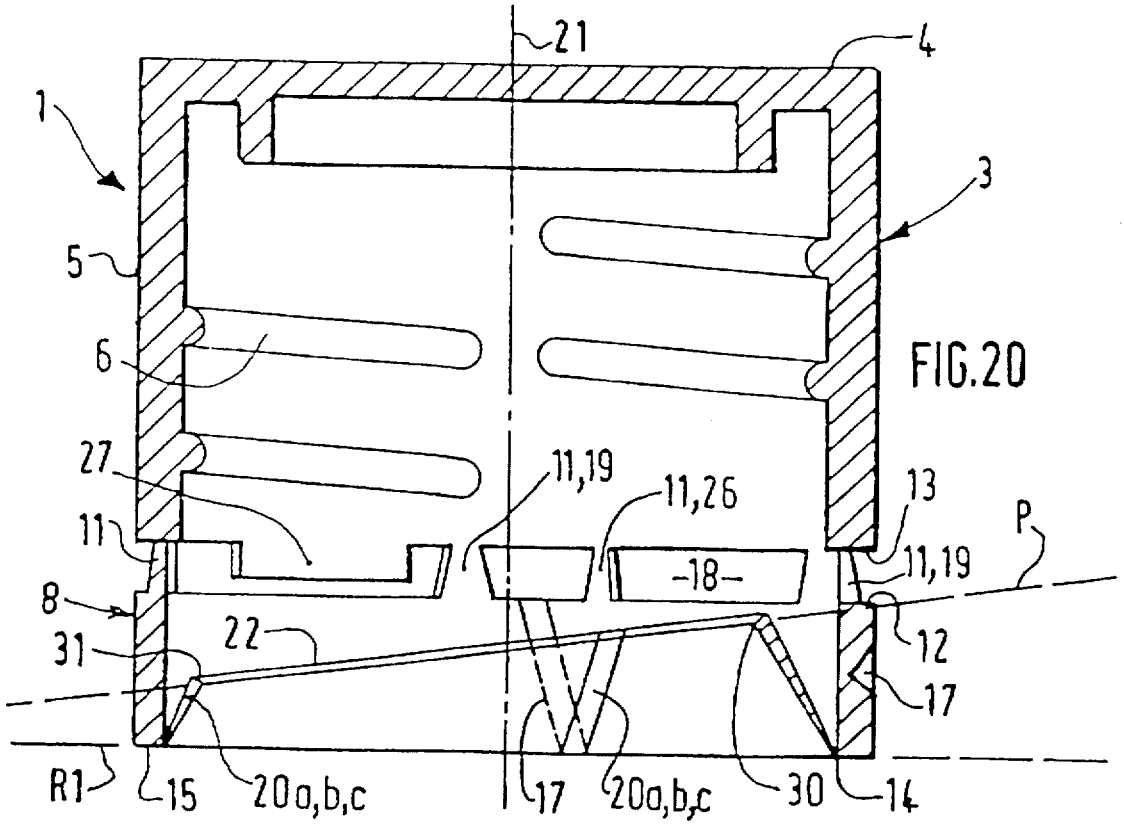
FIG. 20 is a diagrammatic axial section view of a sixth variant embodiment of the cap.
Figure 21:
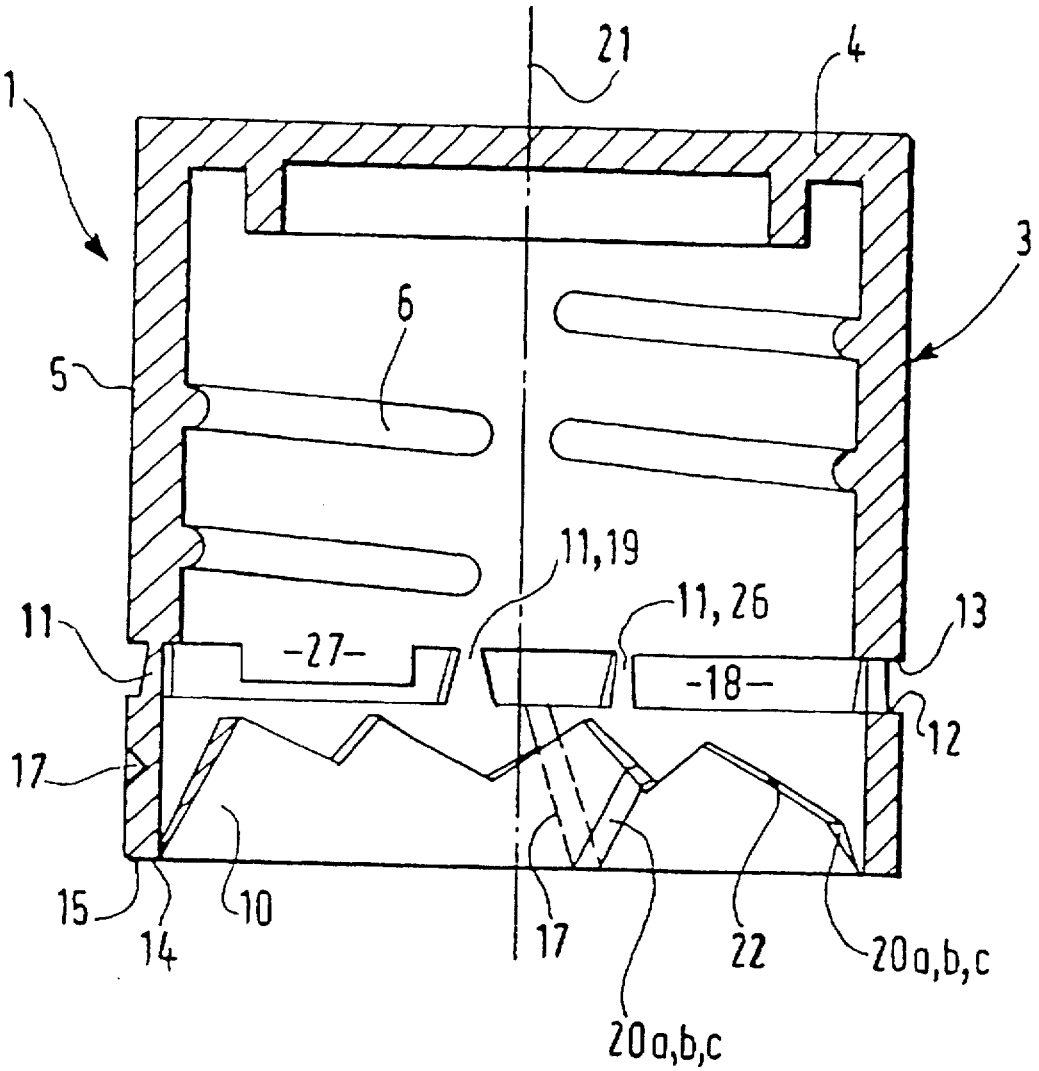
FIG. 21 is a diagrammatic axial section view of a seventh variant embodiment of the cap.

In a fifth and sixth embodiment, the free edge 22 lies substantially entirely in the same plane (see FIGS. 19 and 20). In a seventh variant, the free edge 22 lies in a plurality of planes P (see FIG. 21). In which case, the inner portion 10 may be provided with some number of indentations that are of greater or lesser size. In the fifth variant shown in FIG. 19, the plane P is inclined in the same direction as the thread 6 of the cap, and in the sixth variant shown in FIG. 20, the plane P is inclined in the opposite direction to the thread 6 of the cap.

Plane P is inclined relative to plane R at an angle lying approximately in the range 0° to 10°, and preferably approximately in the range 3° to 4°.

In accordance with the invention (FIGS. 20 and 21), the breakable zone 17 is situated facing or nearly facing a location of the inner portion 10 where the inner portion is of greatest axial extent. This location corresponds to a "high point" 30 of the free edge 22, which high point is the point furthest from the edges 14 and 15, and closest to the transverse end wall 4.

In the most general case, the free edge 22 also has a "low point" 31 which is the point closest to the edges 14 and 15, and furthest from the wall 4.

If the high point 30 is preferably close to a breakable zone 17, conversely a breakable zone 20*a*, a cut 20*b*, or a gap 20*c* in the inner portion 10 is situated facing or nearly facing a location of the inner portion 10 where the inner portion is of least axial extent, i.e. facing or in the vicinity of the low point 31.

Plane P may have three different positions relative to the transverse reference plane R1 defined by the edge 15:

either plane P intersects plane R1 along a line that is substantially tangential to the outer portion 9 (FIG. 22), in which case a gap 20*c* is defined at the low point 31;

or plane P intersects plane R1 inside the cap, i.e. along a line that intersects the outer portion (FIG. 22*b*); this enables a gap 20*c*, a cut 20*b*, or a breakable zone 20*a* to be defined at the low point 31;

or else plane P intersects plane R1 outside the outer portion 9 (FIG. 22*c*); this defines a gap 20*c* in the inner portion 10 at the low point 31.

Figure 22A:
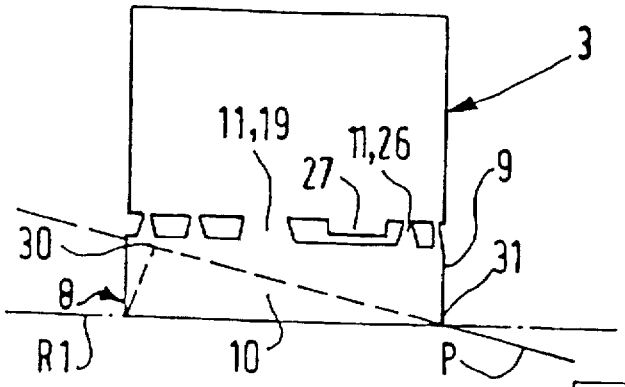
FIGS. 22*a*, 22*b*, 22*c*, and 22*d* are diagrammatic elevation views showing various embodiments of the inner portion in dashed lines.
Figure 22B:
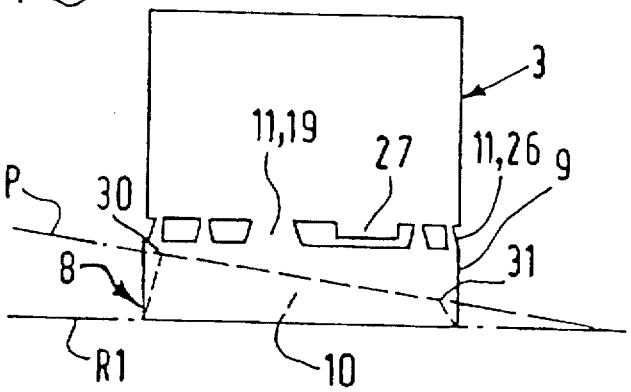
Figure 22C:
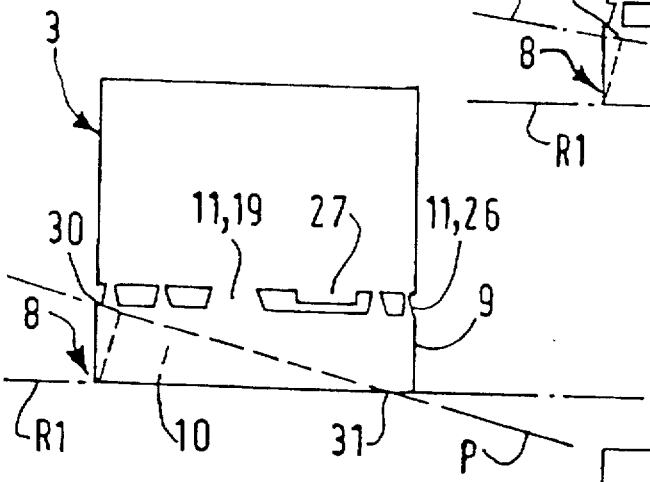
Figure 22D:
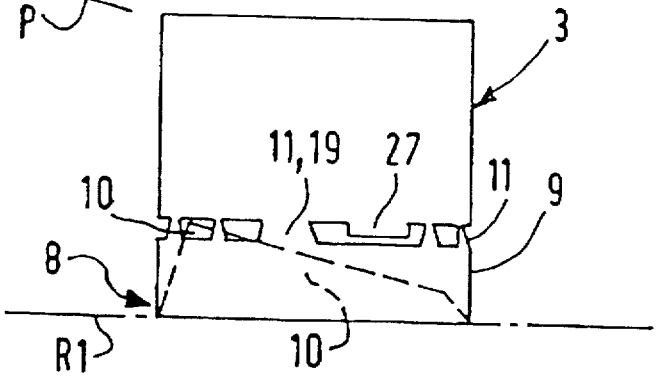

In another embodiment, a portion of the inner portion 10 extends axially beyond the outer portion, and a portion of the inner portion does not extend beyond the outer portion (FIG. 22*d*).

In a method of manufacturing a cap such as described above, firstly it is made by injection with the inner portion 10 extending the outer portion 9. Then the inner portion 10 is pivoted about its thin edge 14 so as to project back inside the ring 8.

Once the inner portion 10 projects back inside the ring 8, the cap 1 can be screwed on the container 2.

Naturally, although only certain embodiments of the invention have been described, any modification made in the same spirit by a person skilled in the art remain within the ambit of the present invention. For example, any mutual combination of the different variants described remain within the ambit of the invention. In particular, the individual dispositions of the link means described in variants one to four are combinable with any one of variants five to seven relating to the inclination of the free edge.

We claim:

1. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the can (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the at least one breakable zone (17) in the outer portion (9) curves away from the empty space (18) between the outer portion (9) and the skirt (5) so that it substantially extends the empty space (18).

2. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the second end termination of the breakable zone on the outer portion is one of a breakable zone (20*a*) and a cut (20*b*) in the inner portion (10) which extends in a generally inclined direction relative to a rotational axis (21) of the cap (1);

wherein the at least one breakable zone (17) in the outer portion (9) has at least one segment (24) that is orthogonal to the axis (21) of the cap (1) and that is interposed between two segments (24*a*, 24*b*) that are inclined relative to the axis.

3. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the second end termination of the breakable zone on the outer portion is the 30°–90° gap (20*c*) in the inner portion (10), constituted by an empty space (20*d*) that extends circumferentially in said inner portion (10).

4. A cap according to claim 3, wherein the empty space (20*d*) extends over an arc of angle substantially corresponding to an angle through which a facing non-breakable fastening (19) extends.

5. A cap according to claim 3, wherein two edges delimiting the gap (20*c*) in the inner portion (10) are disposed to be one of substantially in axial planes of the cap (1), and divergent from the thin edge (14) of the inner portion (10) to a free edge (22) of the inner portion.

6. A cap according to claim 5, wherein the edges delimiting the gap (20*c*) in the inner portion (10) are inclined relative to the axis (21) of the cap (1) at an angle of approximately 45°.

7. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the inner portion (10) extends over an axial height which is not more than the axial height of the outer portion (9);

wherein the inner portion (10) extends over about one half of the axial height of the outer portion (9).

8. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the inner portion (10) extends over an axial height that is greater than the axial height of the outer portion (9) which covers the inner portion (10) in part only, with the inner portion partially overlapping the skirt (5).

9. A screw cap made of a plastics material, the cap comprising:

a closing portion (3) having:

a transverse end wall (4) and a skirt (5) adjoining the wall (4) and provided with an inside thread (6); and a tamper-proofing ring (8) formed integrally with the closing-portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the link means (11) are constituted by the non-breakable fastenings (19) only;

wherein there are at least two breakable zones (17, 20*a*) in the outer portion (9) and in the inner portion (10).

10. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the link means (11) are constituted both by the non-breakable fastenings (19) and also by breakable bridges (26) that are spaced apart circumferentially, and that are broken on unscrewing the cap (1);

wherein a right cross-section of the breakable bridges (26) is generally triangular with a base adjoining an inside face of the skirt (5), and an inside face of the outer portion (9), and an opposite vertex facing outwards.

11. A cap according to claim 10, wherein the vertex is disposed slightly set back from an outside face of the skirt (5) and from an outside face of the outer portion (9).

12. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

further comprising at least one axial abutment (27) formed as at least one of a projection on the skirt (5) and a projection on the outer portion (9), being situated in the empty space (18) provided between the skirt and the outer portion, if disposed on the skirt extending the skirt from its free edge (13) towards the outer portion (9), if disposed on the outer portion extending the outer portion from its free edge (12) towards the skirt (5);

wherein two adjacent abutments (27) are separated from each other by not more than four breakable bridges (26).

13. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the link means (11) are constituted both by the non-breakable fastenings (19) and also by breakable bridges (26) that are spaced apart circumferentially, and that are broken on unscrewing the cap (1);

wherein one of the at least one non-breakable fastenings (19) is spaced apart from a first of the breakable bridges (26) situated upstream relative to the unscrewing direction of the cap (1) by an arc lying approximately in the range 45° to 90°;

wherein one of the at least one non-breakable fastenings (19) is spaced apart from the first breakable bridge (26) situated upstream relative to the unscrewing direction of the cap (1) by an abutment (27).

14. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

further comprising at least one axial abutment (27) formed as at least one of a projection on the skirt (5) and a projection on the outer portion (9), being situated in the empty space (18) provided between the skirt and the outer portion, if disposed on the skirt extending the skirt from its free edge (13) towards the outer portion (9), if disposed on the outer portion extending the outer portion from its free edge (12) towards the skirt (5);

wherein one of the at least one axial abutments (27) adjoins the skirt (5), the abutment having rounded edges, and a radial thickness that is substantially equal to a radial thickness of the skirt (5).

15. A screw cap made of a plastics material, the cap comprising:

a closing portion (3) having:

a transverse end wall (4) ; and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a protection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the can (1), the tamper-proofing ring (8) remains attached to the closing portion (3);

further comprising at least one axial abutment (27) formed as at least one of a projection on the skirt (5) and a projection on the outer portion (9), being situated in the empty space (18) provided between the skirt and the outer portion, if disposed on the skirt extending the skirt from its free edge (13) towards the outer portion (9), if disposed on the outer portion extending the outer portion from its free edge (12) towards the skirt (5);

wherein the at least one axial abutment comprises at least two abutments (27) which occupy approximately in the range one third to one half of a circumference of the empty space (8) between the skirt and the outer portion (9).

16. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the can (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the link means (11) are constituted both by the non-breakable fastenings (19) and also by breakable bridges (26) that are spaced apart circumferentially, and that are broken on unscrewing the cap (1);

wherein one of the at least one non-breakable fastenings (19) is situated substantially diametrically opposite from one of another of the non-breakable fastenings (19) and one of the breakable bridges (26).

17. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the link means (11) are constituted both by the non-breakable fastenings (19) and also by breakable bridges (26) that are spaced apart circumferentially, and that are broken on unscrewing the cap (1);

further comprising four breakable bridges (26) substantially uniformly distributed over one half of a periphery of the cap (1) opposite from a single breakable zone (17) of the outer portion (9), and from one of the breakable zone (20*a*), cut (20*b*), and gap (20*c*) in the inner portion (10).

18. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the link means (11) are constituted both by the non-breakable fastenings (19) and also by breakable bridges (26) that are spaced apart circumferentially, and that are broken on unscrewing the cap (1);

further comprising three abutments (27), two of which are diametrically opposite each other, the third abutment being diametrically opposite the non-breakable fastening (19).

19. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

further comprising two substantially diametrically opposite non-breakable fastenings (19), and two substantially diametrically opposite inner portion regions comprising one of breakable zones (20*a*), cuts (20*b*), and gaps (20*c*).

20. A cap according to claim 19, further comprising six breakable bridges (26) arranged in diametrically opposite pairs and that are situated midway of segments of the inner portion (10) that are separated by the diametrically opposite inner portion regions.

21. A cap according to claim 19, further comprising four abutments (27) arranged in opposite pairs, and separated from one another either by one of the breakable bridges (26) and the non-breakable fastenings (19).

22. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

further comprising three non-breakable fastenings (19) disposed at substantially 120° from one another, and three inner portion regions comprising one of breakable zones (20*a*), cuts (20*b*), and gaps (20*c*) also disposed at substantially 120° from one another.

23. A cap according to claim 22, further comprising six breakable bridges (26) disposed at substantially 60° from one another, situated substantially in a middle of the inner portion (10), and diametrically opposite the non-breakable fastenings (19).

24. A cap according to claim 22, further comprising six abutments (27) disposed at substantially 60° from one another.

25. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein there are four non-breakable fastenings (19) spaced apart from one another by substantially one fourth of a turn.

26. A cap according to claim 25, wherein there are four breakable bridges (26) and four inner portion regions comprising one of breakable zones (20*a*), cuts (20*b*) and gaps (20*c*) that are spaced apart from one another by substantially one fourth of a turn.

27. A cap according to claim 25, wherein the non-breakable fastenings (19) are the only link members (11), and wherein there are four breakable zones (20*a*) in the inner portion (10) spaced apart from one another by substantially one fourth of a turn.

28. A screw cap made of a plastics material, the cap comprising:

a closing portion (3) having:

a transverse end wall (4); and a skirt (5) adjoining the wall (4) and provided with an inside thread (6); and a tamper-proofing ring (8) formed integrally with the closing portion (3), and having:

an outer portion (9) forming a closed loop, disposed in alignment with the skirt (5), and connected thereto via link means (11) spaced apart circumferentially between a free edge (12) of the outer portion (9) and a free edge (13) of the skirt (5), a lower edge (15) of the outer portion directly adjoining:

a thin edge (14) of an inner portion (10) that can be pivoted about the thin edge relative to the outer portion (9), the inner portion (10) being designed to project back inside the ring (8) towards the transverse end wall (4) such that the inner portion is Positioned to interfere with a projection (16) on a container (2) on which the cap (1) is meant to be screwed;

at least one breakable zone (17) on the outer portion (9) of said tamper-proofing ring (8) enabling it to be opened on unscrewing the cap (1) terminating at a first end on an empty space (18) between the outer portion (9) and the skirt (5), which empty space (18) is delimited downstream, with respect to the unscrewing direction of the cap (1), by at least one non-breakable fastening (19) which does not break on unscrewing the cap (1), and which is part of said link means (11), and terminating at a second end on one of a breakable zone (20*a*), a cut (20*b*), and a gap spanning 30°–90° of a circumference of the inner portion, (20*c*) disposed on the inner portion (10) so that, on unscrewing the cap (1), the tamper-proofing ring (8) remains attached to the closing portion (3);

wherein the inner portion (10) is delimited by a free edge (22) lying in at least one plane P that is inclined relative to a reference plane R which is orthogonal to the axis (21) of the cap.

29. A cap according to claim 28, wherein the free edge (22) lies in a plurality of planes P.

30. A cap according to claim 28, wherein a plane P is inclined relative to plane R at an angle lying approximately in the range 3° to 4°.

31. A cap according to claim 28, wherein the free edge (22) lies substantially entirely in a single plane P.

32. A cap according to claim 31, wherein one of the at least one breakable zones (17) is situated facing or nearly facing a location of the inner portion (10) where the inner portion is of greatest axial extent.

33. A cap according to claim 28, wherein one of a breakable zone 20*a*, a cut 20*b*, and a gap 20*c* in the inner portion 10 is situated facing a location of the inner portion (10) where the inner portion is of least axial extent.

34. A cap according to claim 33, wherein a plane P intersects a transverse plane R1 of an edge of the skirt (15) along a line that is one of substantially tangential to the outer portion (9), intersects the outer portion (9), and lies outside the outer portion (9).

* * * * *